US005501194A

United States Patent [19]

Kanehara et al.

[11] Patent Number: 5,501,194

[45] Date of Patent: Mar. 26, 1996

[54] FUEL INJECTION APPARATUS

[75] Inventors: Kenji Kanehara, Toyohashi; Toshihiko Igashira, Toyokawa; Ikuo Watanabe, Okazaki; Masanori Okada; Jun-ichi Matsudaira, both of Toyota, all of Japan

[73] Assignees: Nippon Soken Inc., Nishio; Toyota Jidosha Kabushiki Kaisha, Toyota, both of Japan

[21] Appl. No.: 300,553

[22] Filed: Sep. 7, 1994

[30] Foreign Application Priority Data

Sep. 9, 1993 [JP] Japan ..... 5-224537

[51] Int. Cl.[6] ..... F02M 69/04

[52] U.S. Cl. ..... 123/470; 123/472; 123/590

[58] Field of Search ..... 123/472, 590, 123/470, 188.14, 308, 432

[56] References Cited

U.S. PATENT DOCUMENTS

| | | | |
|---|---|---|---|
| 4,763,624 | 8/1988 | Deckers | 123/308 |
| 4,779,594 | 10/1988 | Oda et al. | 123/308 |
| 4,957,081 | 9/1990 | Ito et al. | 123/308 |
| 5,150,691 | 9/1992 | Imajo | 123/472 |
| 5,295,464 | 3/1994 | Ando et al. | 123/188.14 |

FOREIGN PATENT DOCUMENTS

| | | |
|---|---|---|
| 58-18055 | 2/1983 | Japan . |
| 59-141765 | 8/1984 | Japan . |
| 64-47972 | 3/1989 | Japan . |

*Primary Examiner*—Henry C. Yuen
*Assistant Examiner*—Erick Solis
*Attorney, Agent, or Firm*—Cushman, Darby & Cushman

[57] ABSTRACT

A fuel injection apparatus in which the state of vaporization of the fuel in the internal combustion engine is improved by making the fuel spray injected from the fuel injector not strike the umbrella portion of the intake valve from the front, but be oriented to a position shifted to the right or left of the stem so that the majority of the spray flows in to a valve seat clearance of an annular groove shape formed between the valve face and the valve seat and causes a swirl in the same. The wet amount of the fuel depositing as a liquid film on the umbrella portion and the inner surface of the intake port, which is difficult to evaporate, is reduced.

8 Claims, 5 Drawing Sheets

FUEL INJECTION APPARATUS

BACKGROUND OF THE INVENTION

1. Field of the Invention

The present invention relates to a fuel injection apparatus for injecting fuel in an intake port of an internal combustion engine, particularly to the rear surface of an intake valve.

2. Description of the Related Art

FIGS. 3 and 4 show a related art for comparison with the present invention. In these figures, 1 is an intake valve, 2 is a stem of the intake valve, and 3 is a valve face of the intake valve. The valve face 3 forms a conical surface and is polished. Reference numeral 4 shows an end portion (intake port) of an intake port. A fuel injector 5 is attached to this so that its injection port 6 is brought close to a depression formed at a part of the same. As clear from FIG. 3 and FIG. 4, in the past, the part A of the umbrella portion comprised of a curved surface of a surface of revolution formed at the rear surface of the intake valve 1 is used as the "spray target position" and the fuel injector 5 and the direction of the injection port 6 of the same are set so that the fuel spray injected from the fuel injector 5 heads toward the position A and strikes the front surface of the same perpendicularly. Note that 7 is the center line of the fuel spray and that 8 is a throttle valve provided at an upstream portion of the intake port 4.

In a conventional fuel injection apparatus as mentioned above, the "spray target position" is set to a portion such as A on the umbrella portion 1*a* of the intake valve, so the angle of incidence of the center line 7 of the fuel spray with respect to the normal line at the position A becomes approximately 0 and the angle θ of the center line 7 of the fuel spray intersecting with the surface of the umbrella portion 1*a* becomes about 90 degrees as shown in FIG. 4. That is, the center line 7 of the fuel spray substantially coincides with the normal line at the position A. Therefore, the fuel spray striking the position A of the intake valve 1 deposits at the rear surface of the intake valve 1, including the part of the umbrella portion 1*a*, as shown as W in FIG. 3 and FIG. 4, and then spreads to its surroundings. Part of the fuel spray also sprays and deposits on the inner surface of the intake port 4. The fuel deposited on these surfaces forms liquid films on these surfaces.

Even if the intake valve 1 opens and a flow of intake air occurs in the intake port 4, the flow rate of the intake air in the vicinity of the umbrella portion 1*a* and on the inner surface of the intake port 4 is relatively low, so part of the fuel depositing on the umbrella portion 1*a* etc. and forming the liquid film evaporates slowly and remains in the intake port 4 unevaporated. The fuel of the portion other than that remaining as a liquid film in the intake port 4 flows down to part of the valve face 3 and flows into the combustion chamber of the engine when the intake valve 1 opens, but at the time of engine startup or cold acceleration etc. when the amount of injection becomes larger, fuel builds up in a narrow range of about one-third of the valve face 3, so the fuel becomes a liquid film even when flowing from the opened intake valve 1 to the combustion chamber.

In the conventional fuel injection apparatus, a liquid film is formed in a relatively broad area in the intake port 4 in this way, so the entire amount of the fuel injected from the fuel injector 5 is not supplied immediately inside the combustion chamber of the engine. This causes a reduction in the response to fuel injection control. Further, depending on the operating state of the engine, even the fuel flowing into the combustion chamber becomes a liquid film, so the state of vaporization of the fuel in the combustion chamber becomes incomplete and the state of combustion deteriorates. Accordingly, poor startup, rough acceleration, or other undesirable states occur due to these factors, the liquid film of the fuel remaining deposited on the intake port 4 evaporates at the time of deceleration and causes the air-fuel ratio in the combustion chamber to become overly rich, and therefore an increase in emission of HC and CO in the exhaust may result.

SUMMARY OF THE INVENTION

The present invention has as its object to resolve the above problems seen in the fuel injection apparatuses of conventional internal combustion engines by a simple means and to provide a fuel injection apparatus which is able to reduce the amount of fuel depositing in large amounts on the umbrella portion of the intake valve and the inner surface of the intake port and forming a liquid film, especially at the time of startup or cold acceleration.

In the present invention, by setting the center line of the fuel spray injected from the injection port of the fuel injector to intersect a spray target position, shifted to either the left or right side of the stem at the rear surface of the intake valve, with a large angle of incidence such as for example 45 degrees or more, the fuel spray is made to be introduced in an annular groove-like clearance (valve seat clearance) formed between the valve face of the intake valve and the valve seat face facing the same, thereby enabling the fuel spray to swirl annularly in the same direction inside the valve seat clearance.

In some cases, part of the flow of intake air is bypassed and ejected in the tangential direction to near the valve seat clearance in the same direction as the swirl of the fuel spray in the valve seat clearance so as to strengthen the swirl of the fuel spray formed in the valve seat clearance. Further, to heighten the effect of the present invention, the volume of the valve seat clearance is made larger than the maximum amount of injection at a single injection of the fuel injector to make it, as necessary, about 1.5 to 3 times that volume. In any case, the angle of spread of the spray of the injection port of the fuel injector is set so that the fuel spray does not substantially strike the inner wall surface of the intake port.

The center line of the fuel spray injected from the fuel injector is shifted to either the left or the right of the stem. Further, the angle of incidence of the center line with respect to the surface of the umbrella portion is a large one of over 45 degrees for example. In other words, the angle between the center line and the surface of the umbrella portion of the intake valve is small, so the amount of the fuel spray hitting the inner wall surface of the intake port at the time of contacting the surface of the umbrella portion is small. Almost all of the fuel spray flows into the annular groove-like valve seat clearance along the surface of the umbrella portion and forms an annular flow which swirls in a single direction in the valve seat clearance. When the bypassed flow of intake air is supplied in the same direction as the flow, the swirl of the fuel spray in the valve seat clearance is further strengthened. When the volume of the valve seat clearance is of a sufficient magnitude of 1.5 to 3 times the maximum injection volume of the fuel injector at a single injection, the fuel spray flowing in does not flow out of the valve seat clearance so much as before.

When the intake valve opens, the flow rate of the intake air near the valve seat becomes higher than the flow rate of the intake air at the surface of the umbrella portion of the intake valve, so the fuel spray swirling in the valve seat clearance evaporates more easily than fuel deposited on the umbrella portion etc. in a liquid film state and the amount of the fuel remaining as a liquid film in the intake port becomes extremely small. Further, by the swirling of the fuel spray in the valve seat clearance, the fuel spray travels to all of the valve seat clearance and therefore the fuel spray rides the intake air to diffuse homogeneously in the combustion chamber when the intake valve is opened. Further, the valve face and the valve seat face in contact with the same are polished to improve the air-tightness of the intake valve and make buildup of deposit difficult, so even if a small amount of deposit is formed, the amount of fuel spray absorbed by the same is of a negligibly small extent.

By working the present invention, it becomes possible to reduce the amount of injection of fuel at the time of startup and cold acceleration, so it is possible to improve the fuel economy. Further, since the amount of fuel adhering to the deposit on the intake valve is small, it is possible to maintain the usually excellent starting performance and superior response to fuel injection control (in particular acceleration). Further, it is possible to prevent the air-fuel ratio in the combustion chamber from becoming over rich at the time of engine deceleration, so there is the effect that no large increase in the emission of HC and CO in the exhaust is caused.

BRIEF DESCRIPTION OF THE DRAWINGS

These and other objects and effects of the present invention will become clearer from the following description of the preferred embodiments with reference to the appended drawings, in which.

DESCRIPTION OF THE PREFERRED EMBODIMENTS

Figure 1:
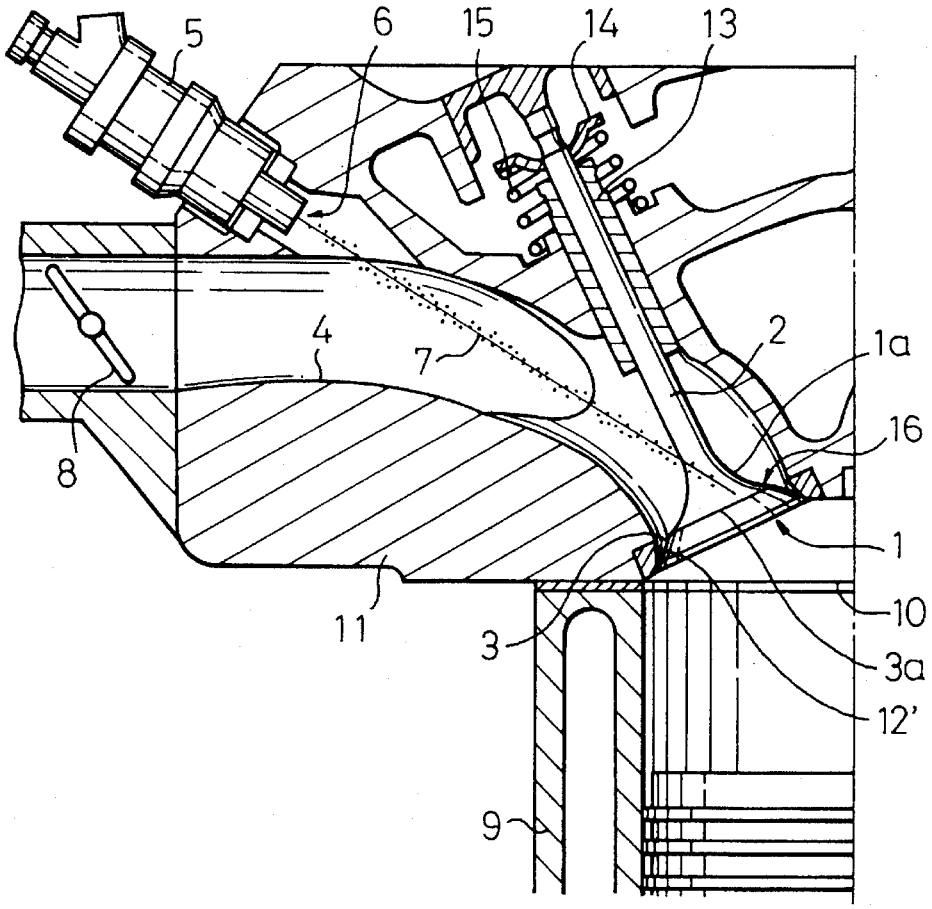
FIG. 1 is a partial cross-sectional view of an engine according to a first embodiment of the present invention.
Figure 2:
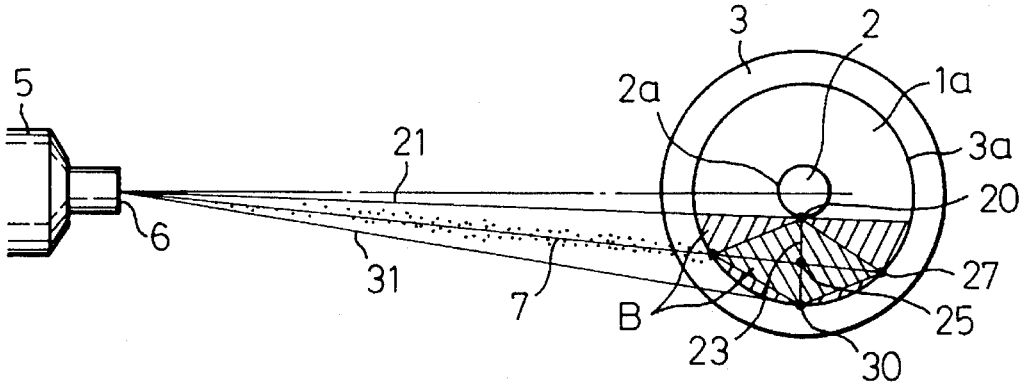
FIG. 2 is a plane view for explaining the spray target position in the first embodiment.

A first embodiment of the present invention is shown in FIG. 1 and FIG. 2. FIG. 1 shows a single cylinder of a multi-cylinder internal combustion engine. Similar to the above-mentioned related art, 1 shows an intake valve, 1*a* an umbrella portion, 2 a stem of the intake valve 1, 3 a valve face, 4 an intake port at its end portion, 5 a fuel injector, 6 an injection port of the same, 7 a center line of the fuel spray which is injected, and 8 a throttle valve. Almost all of the construction of the internal combustion engine of the first embodiment shown in FIG. 1, however, is not particularly characteristic of the present invention. These portions are similar to those in conventional internal combustion engines. These too, however, will be explained below.

In the same way as the construction of the conventional internal combustion engine, a cylinder head 11 is affixed on the cylinder block 9 through a gasket 10. Inside the cylinder head 11 is formed the afore-mentioned intake port 4. Further, at the open end of the intake port 4 is attached an annular valve seat 12 by casting, press-fitting, or other methods. In the closed valve state, the circumferential edge of the valve face 3 of the intake valve 1 comes into close annular contact with the valve seat face 12' and closes off the intake port 4 from the combustion chamber. To maintain the open state of the intake valve 1 in the strokes other than the intake stroke, the stem 2 of the intake valve 1 is inserted into the cylindrical valve guide 13 press-fitted to the cylinder head 11. A retainer 14 is attached to the front end of the stem 2 and a compressed valve spring 15 is attached between the retainer 14 and the cylinder head 11.

Figure 3:
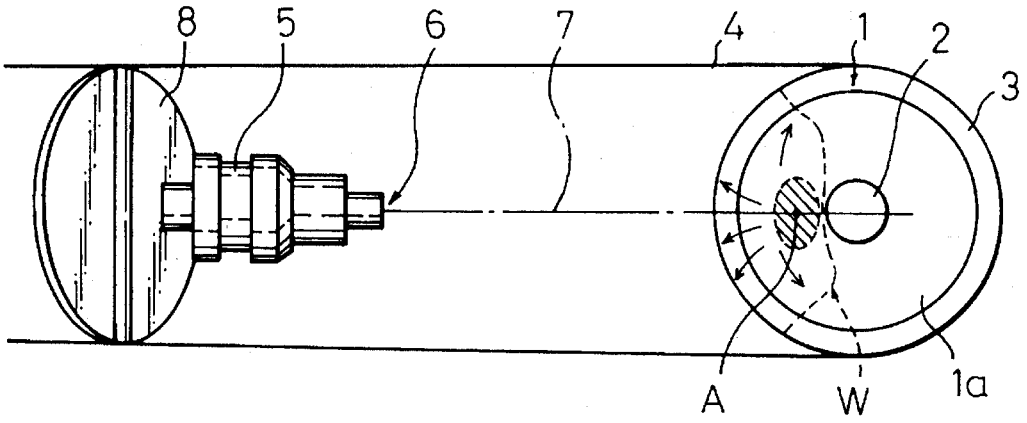
Fig. 3 PRIOR ART
FIG. 3 is a plane view showing the conventional spray target position.
Figure 4:
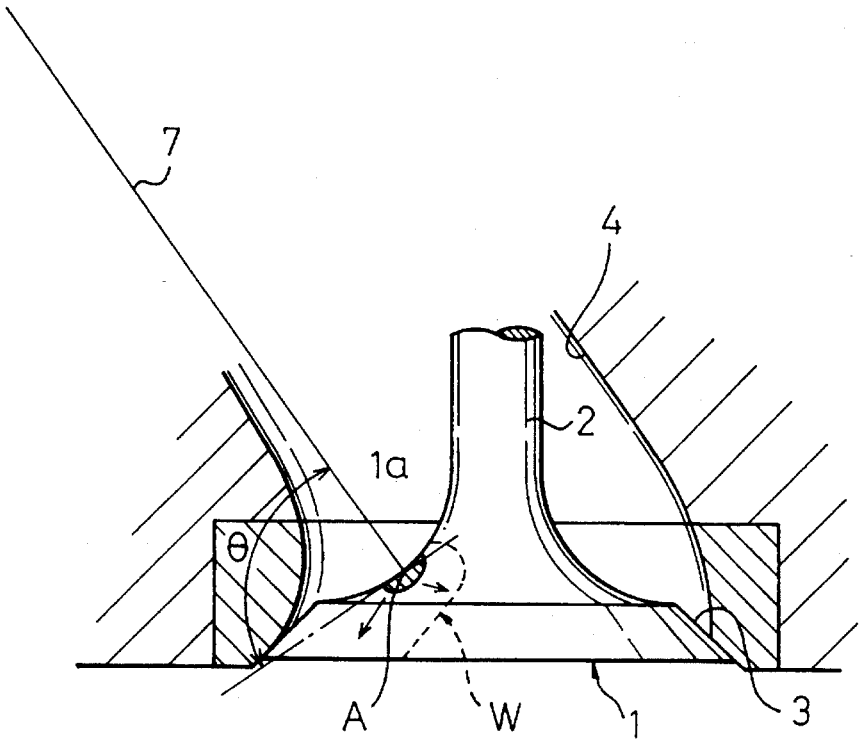
Fig. 4 PRIOR ART
FIG. 4 is a cross-sectional view showing the conventional spray target position.

The fuel injection apparatus of the first embodiment shown in FIG. 1 and FIG. 2 differs from the conventional example shown in FIG. 3 and FIG. 4 mainly in the spray target position. Rather than use the portion a of the front surface of the umbrella portion 1*a* of the intake valve which is substantially perpendicular (angle of incidence of 0) with respect to the center line 7 of the fuel spray as in the conventional example, the front end of the center line 7 of the fuel spray is made to deviate to either the right or left side of the stem 2, whereby the angle of incidence with respect to the surface of the umbrella portion 1*a* of the intake valve is made an extremely large one of for example 45 degrees or more. In regard to this point, the case of the first embodiment where the center line 7 of the fuel spray is shifted to the right side of the stem 2, for example, as seen from the injection port 6 will be explained in detail with reference to FIG. 2.

The injection port 6 of the fuel injector 5 used in the first embodiment is a single port. The shape of the fuel spray produced by this is a so-called pencil stream. In the plane view of the intake valve 1 of FIG. 2, consideration is given to the first tangent 21 extending from the center of the injection port 6 and contacting the outer circumference 2*a* of the stem 2 at the first contact point 20, consideration is given to the second tangent 31 extending from the center of the injection port 6 and contacting the inner circumference 3*a* of the valve face 3 at a second contact point 30, and the direction of the injection port 6 of the fuel injector is set so that the center line 7 of the fuel spray is between these tangents 21 and 31. In other words, in the first embodiment, the spray target position is selected from inside the region B at the right side of the umbrella portion 1*a* of the intake valve 1 as seen from the fuel injector 5 and shown by the hatching in FIG. 2. Note that in selecting the position, a check should be made if the center line 7 of the fuel spray intersects the provisionally selected spray target position on the surface of the umbrella portion 1*a* of the intake valve by a large angle of incidence of at least 45 degrees. Further, such a hatched region B may also be the portion deviated to the left of the stem 2 as seen from the fuel injector 5.

The position particularly preferable as the spray target position in the portion of the hatched region B is on the line connecting the mid-point 25 of the line connecting the contact point 20 and the contact point 30 and the center of the injection port 6. In FIG. 2, therefore, the center line 7 of the fuel spray is drawn superposed on this line. The spray target position should in particular be on this line at a position further from the mid-point 25 as seen from the fuel injector 5, so in the final analysis, the most preferable spray target position can be said to be in the range from the center point 25 shown in FIG. 2 to the point 27 on the inner circumference 3*a* of the valve face 3. For practical purposes, the spray target position should be set in the triangular region comprised by the two contact points 20 and 30 and the point 27. It goes without saying that there is a suitable range like this on the other side of the stem 2 as well.

The valve face 3 of the intake valve 1 and the valve seat face 12' of the cylinder head 11 side, both of which are polished, contact each other with an angle of about 30 degrees, so when the intake valve 1 is closed, a valve seat clearance 16 with a triangular cross-section forming an overall annular groove like space is formed between these two faces 3 and 12'. In the case of the first embodiment where the spray target position is selected as mentioned before, the majority of the fuel spray injected from the injection port 6 of the fuel injector 5 flows into the valve seat clearance 16. The center line 7 of the fuel spray is shifted to the right side (or left side) of the stem of the intake valve 1, so the fuel spray entering is retained while swirling counterclockwise (or clockwise) along the groove of the valve seat clearance 16. During this time, the fuel spray uniformly cools the valve face 3, which is the highest temperature in the intake valve 1, and the valve seat face 12' of the cylinder head 11 side and thereby protects these portions from heat damage. The fuel spray itself absorbs heat and partially evaporates.

When the intake valve 1 opens, the fuel spray accumulated in the valve seat clearance 16 while swirling rides the flow of intake air and flows into the combustion chamber from the nearest position. Accordingly, the amount of the formation of the hard-to-evaporate liquid film deposited on the surface of the inside of the intake port 4, including the umbrella portion 1*a* of the intake valve, out of the injected fuel (wet amount) becomes small and almost all of the fuel spray injected from the fuel injector 5 flows into the combustion chamber substantially simultaneously with the opening of the intake valve 1 without delay, so the response to the fuel injection control is improved. Further, the fuel spray swirls in the valve seat clearance 16 when the intake valve 1 is closed, so it comes into contact with the high temperature valve face 3 and valve seat face 12', and the amount of fuel spray evaporating in the valve seat clearance 16 is large, so according to the first embodiment, the state of vaporization in the combustion chamber is also excellent and a superior state of combustion can be obtained. As a result, improvement of the startup performance, acceleration, and fuel economy of the engine becomes possible and the air-fuel ratio can be prevented from becoming over rich at the time of deceleration, so the amount of emission of HC and CO is reduced as well.

Figure 5:
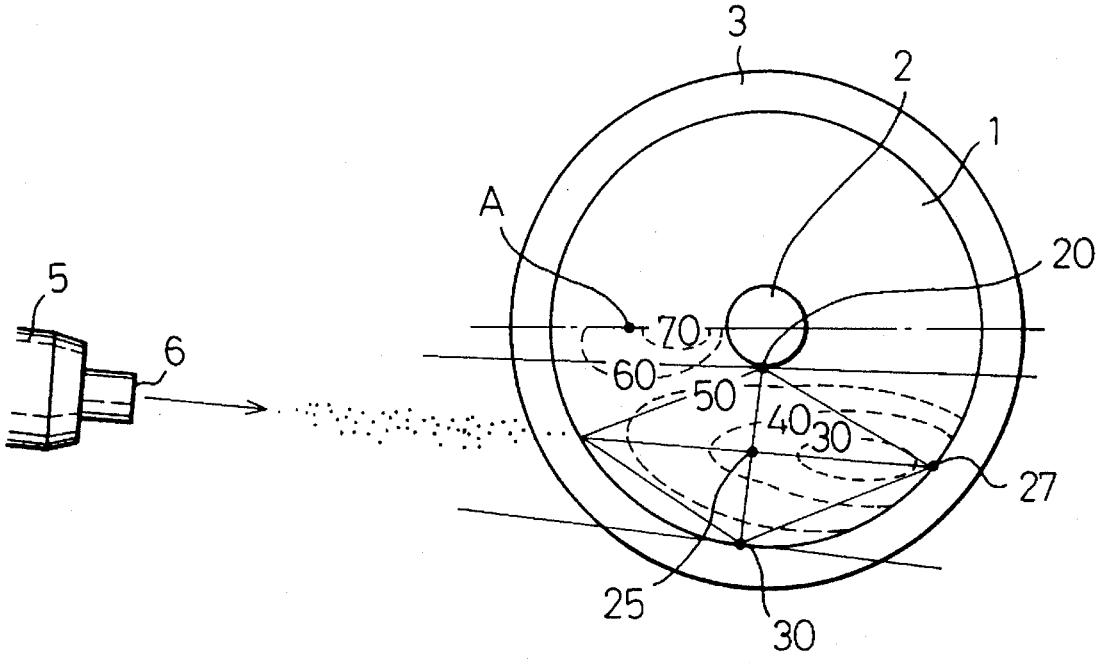
FIG. 5 is a plane view showing the measured values of the wet ratio of the intake port in accordance with the spray target position.

FIG. 5 shows the wet ratio of the intake port in the case of shifting the spray target position to various positions at the right side of the stem 2, including the cases of the first embodiment of the present invention shown in FIG. 1 and FIG. 2 and the conventional example shown in FIG. 3 and 4 as a comparative example, that is, shows the percentage of the actually measured value of the amount of fuel remaining in the intake tape divided by the actually measured amount of injected fuel at that time.

As clear from FIG. 5, the 60 to 70 percent wet ratio of the intake port in the conventional example where the spray target position is near A can be reduced to 50 to 30 percent in accordance with the first embodiment of the present invention and, further, the closer the spray target position to the furthest point 27 from the injection port 6 and the closer the center line 7 of the fuel spray to the line connecting the mid-point 26 and the injection port 6, the smaller the wet ratio. Accordingly, the point 27 can be said to be the most desirable spray target position in the first embodiment.

Figure 6:
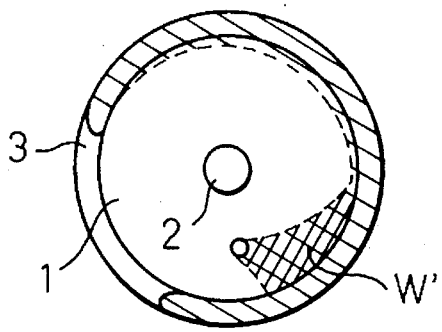
FIG. 6 is a plane view for explaining the state of diffusion of the fuel spray in the first embodiment.

In the case of the comparative example, the position A of the intake valve 1 where deposit easily builds up is used as the spray target position, so when the fuel spray strikes the built-up deposit, not only is the fuel spray absorbed by the deposit and held there, but also the fuel spray is randomly reflected by the deposit and flies over a wide range, so the intake port wet ratio increases about 10 percent. As opposed to this, in the first embodiment, as shown in FIG. 6 by the shaded region W', the range of the liquid film formed by the deposition of the fuel spray is a small one of about one-half of the range of the liquid film W in the comparative example. The valve seat clearance 16, in which almost all the fuel spray flows into, has an extremely small amount of deposit buildup compared with the umbrella portion 1*a* of the intake value due to the facts that the valve face 3 and the valve seat face 12' are polished, the flow rate of the intake air passing through it is high, rotation is given to the intake valve 1, etc. Note that the region shown by the hatching in FIG. 6 shows the fuel spray which diffuses while swirling in the valve seat clearance 16.

Figure 7:
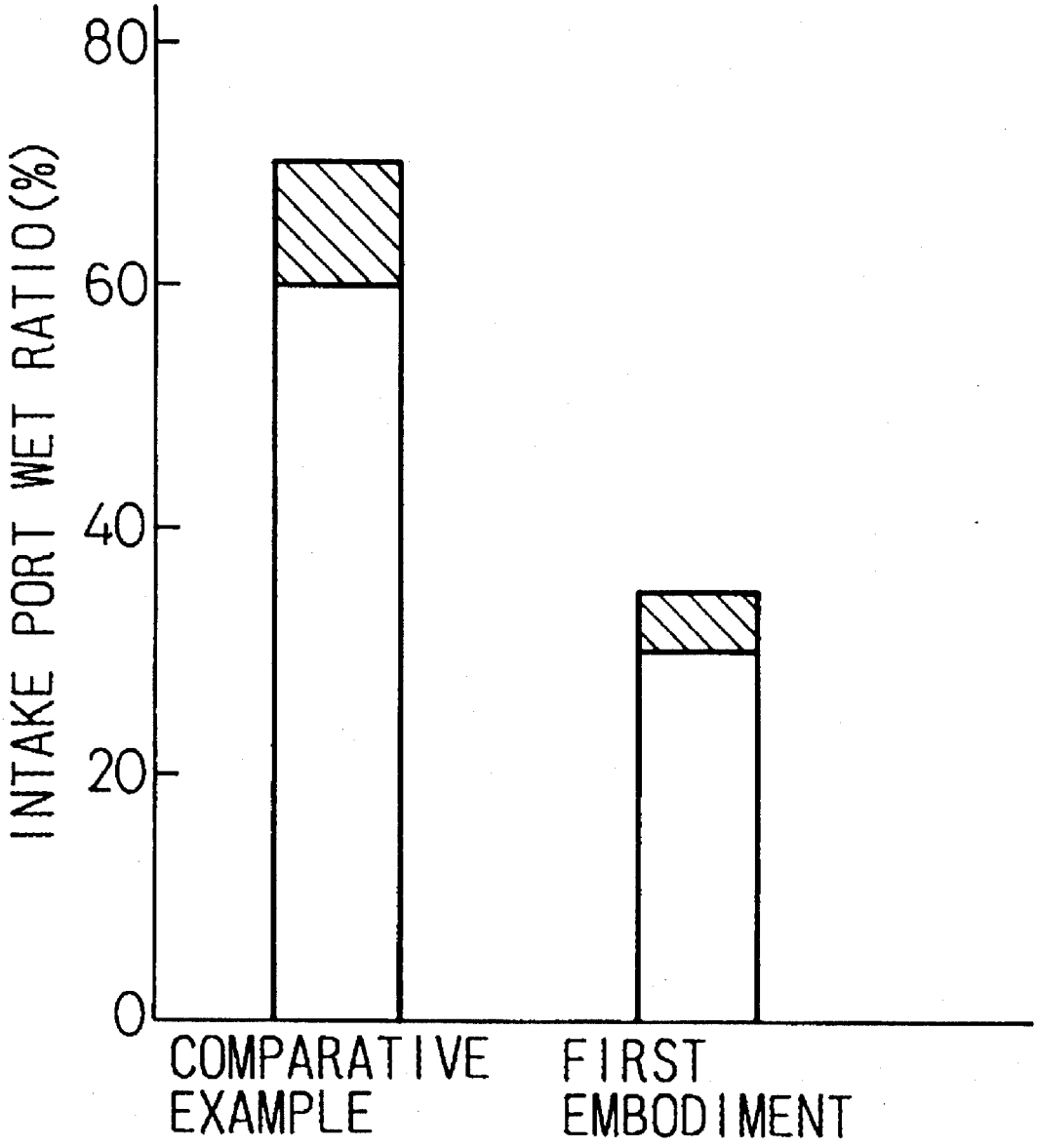
FIG. 7 is a bar graph showing the effect of the present invention as compared with the related art.

FIG. 7 shows a comparison of the magnitudes of the wet ratio of the intake port in engines of the first embodiment and a comparative example measured by experiments under the same operating conditions. The hatched tops of the bars show the amount of increase of the wet ratio of the intake port due to the buildup of deposit. From the experiments, it was learned that the increase in the wet ratio of the intake port due to the deposit in the case of the first embodiment was about one-half that of the comparative example. This is due to the reason explained above.

In the first embodiment, as much of the fuel spray injected from the fuel injector 5 as possible is received in the valve seat clearance 16. When the volume of the valve seat clearance 16 is small, however, the fuel spray flowing in overflows to the direction of the umbrella portion 1*a*, whereby the state of the flow into the combustion chamber changes. However, if the volume is too great, the fuel spray collects at only a part of the valve seat clearance 16 and a sufficiently strong swirl cannot be obtained either, so the fuel spray does not travel uniformly to the entire region of the valve seat clearance 16. As a result, depending on the operating conditions, the ratio of the fuel flowing into the combustion chamber as a liquid film increases and the concentration of the mix of the fuel and air in the combustion chamber becomes nonuniform. In the case of the first embodiment, therefore, the volume of the valve seat clearance 16 is set to a range of 1.5 to 3 times the amount of the maximum fuel injection of the engine based on experimental findings.

Figure 8:
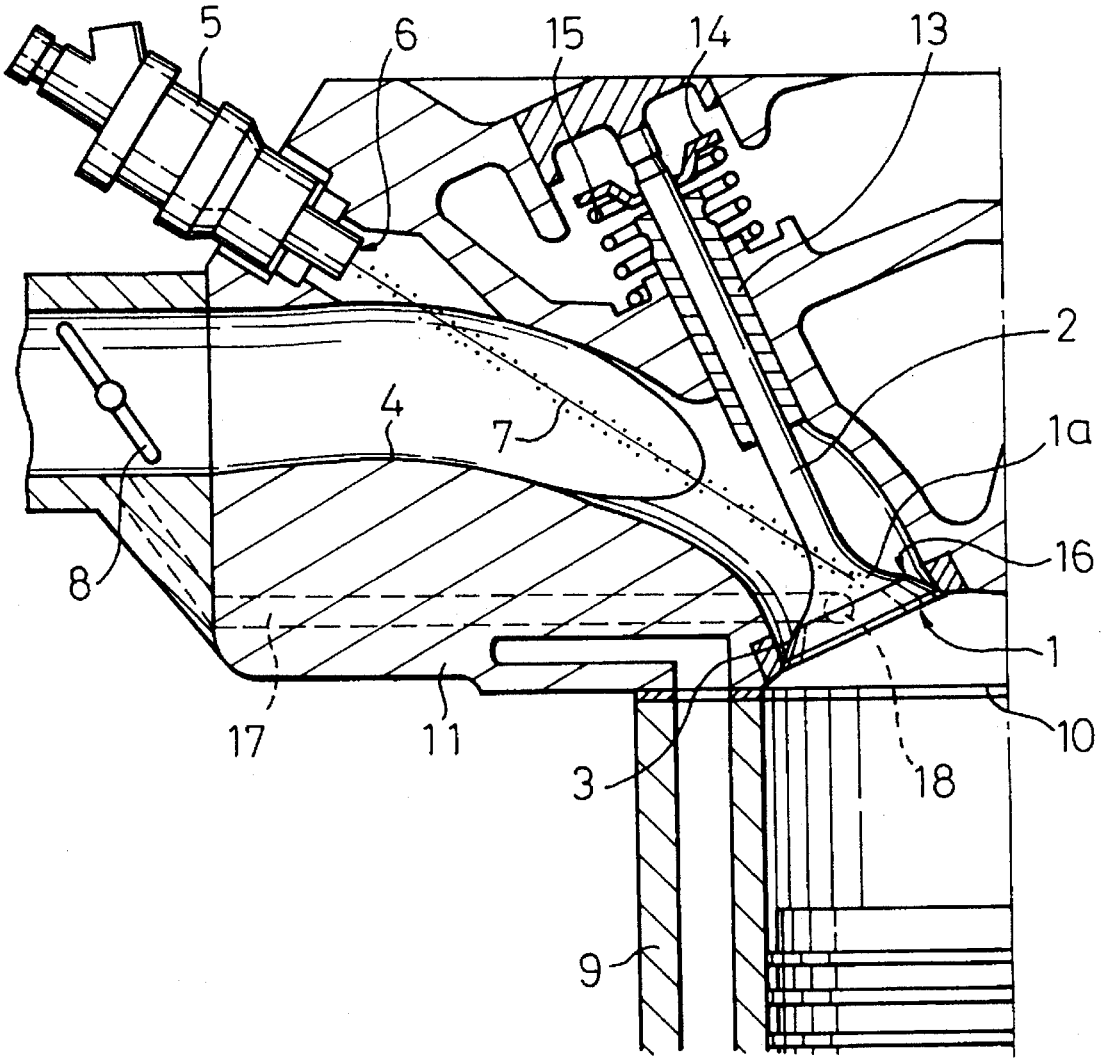
FIG. 8 is a partial cross-sectional view of an engine according to a second embodiment of the present invention.

FIG. 8 shows a second embodiment of the present invention. In this example, in addition to the same construction as in the first embodiment, provision is made of an air passage 17 branching off from the intake port 4 at a position on the upstream side of the throttle valve 8 so as to bypass the throttle valve 8 and the end of the passage is made to open as the ejection port 18 in the valve seat 12. In this case, the ejection port 18 opens in the tangential direction with respect to the annular groove-like valve seat clearance 16. The bypass intake air flow ejected in the tangential direction strengthens the swirl of the fuel spray in the valve seat clearance 16.

According to the second embodiment, even when it is not possible to select the direction of the center line 7 of the fuel spray determined by the mounting position of the fuel injector 5 and the spray target position to be the optimal ones explained in the first embodiment, due to the action of the air ejected from the ejection port 18, the fuel spray about to deposit on the umbrella portion 1*a* of the intake valve is guided to the inside of the valve seat clearance 16 and the swirl of the fuel spray in the clearance 16 can be strengthened. Accordingly, by adopting the means of the second embodiment at the same time, there is the beneficial effect that the degree of freedom of the mounting position of the fuel injector 5 in the first embodiment is increased.

Further, according to the construction of the second embodiment, the negative pressure in the intake port 4 becomes higher when the operating state of the engine is in the light load region, so the flow rate of the air ejected from the ejection port 18 becomes greater and therefore the fuel spray is more easily diffused in the valve seat clearance 16 and homogenization of the concentration of the air-fuel mixture in the combustion chamber is promoted. The smaller the load, the higher the negative pressure in the intake port and the stronger this action becomes, so it is possible to improve the light load operating state where the amount of intake air flowing in the intake port 4 is reduced and the evaporation and diffusion of the fuel spray deteriorate.

In the first and second embodiments, the explanation was made with reference to an engine with a single intake valve 1 and injection port 6 of the fuel injector 5 per cylinder, but the present invention may be effectively applied to even an engine with a number of intake valves provided per cylinder and using a fuel injector 5 provided with a number of injection ports 6 corresponding to the same or an engine provided a means for promoting atomization of the fuel spray at the injection port 6 of the fuel injector 5 by so-called assist air or heating around the intake port 4 or injection port 6 etc. Note that in the case where two intake valves are provided per cylinder and the fuel spray is simultaneously injected from the two injection ports formed in a single fuel injector 5 corresponding to these, it is possible to set things so that the swirls of the fuel spray in the valve seat clearances 16 of the intake valves are caused in opposite directions to each other.

We claim:

1. A fuel injection apparatus including a fuel injector provided in an intake port of an internal combustion engine upstream of an intake valve, said fuel injector injecting a fuel spray inside the intake port, wherein a spray target position, constituting the point where a center line of the fuel spray injected from an injection port of the fuel injector and the intake valve intersect, is set in a region between a first tangent passing through the center of the injection port and contacting one side of the outer circumference of the stem of the intake valve at a first contact point when seen from the stem side and a second tangent passing through the center of the injection port and contacting the inner circumference of the valve face of the intake valve at a second contact point at one side of the outer circumference of the stem, and wherein an ejection port for air is made to open in a tangential direction with respect to the valve seat clearance formed between the valve face and a valve seat face and an air passage connected to the ejection port is branched from the intake port at a position at the upstream side of a throttle valve so as to eject air from the ejection port in the same direction as a swirl of the fuel spray caused in the valve seat clearance.

2. A fuel injection apparatus as recited in claim 1, wherein the spray target position is in a region further from a line connecting said first contact point and said second contact point as seen from the position of said injection port.

3. A fuel injection apparatus as recited in claim 1, wherein the spray target position is in a triangular region comprised of said first contact point, said second contact point, and a point where the line passing through the center of the injection port and extending to the midpoint of the first contact point and second contact point intersects the inner circumference of the valve face.

4. A fuel injection apparatus as recited in claim 1, wherein the angle of incidence of the fuel spray relative to a normal line to a surface of a valve head of the intake valve is at least 45 degrees.

5. A fuel injection apparatus as recited in claim 1, wherein the volume of the valve seat clearance formed between the valve face and the valve seat face at the time of closing of the intake valve is in the range of 1.5 to 3 times the maximum amount of injection.

6. A fuel injection apparatus as recited in claim 2, wherein the volume of the valve seat clearance formed between the valve face and the valve seat face at the time of closing of the intake valve is in the range of 1.5 to 3 times the maximum amount of injection.

7. A fuel injection apparatus as recited in claim 3, wherein the volume of the valve seat clearance formed between the valve face and the valve seat face at the time of closing of the intake valve is in the range of 1.5 to 3 times the maximum amount of injection.

8. A fuel injection apparatus including a fuel injector provided in an intake port of an internal combustion engine upstream of an intake valve and injecting a fuel spray inside the intake port, wherein a spray target position, constituting the point where a center line of the fuel spray injected from an injection port of the fuel injector and the intake valve intersect, is set in a region between a first tangent passing through the center of the injection port and contacting one side of the outer circumference of the stem of the intake valve at a first contact point when seen from the stem side and a second tangent passing through the center of the injection port and contacting the inner circumference of the valve face of the intake valve at a second contact point at one side of the outer circumference of the stem, wherein the volume of the valve seat clearance formed between the valve face and the valve seat face corresponding to the same at the time of closing of the intake valve is in the range of 1.5 to 3 times the maximum amount of injection.

* * * * *